US008413574B2

(12) United States Patent
Oehm et al.

(10) Patent No.: US 8,413,574 B2
(45) Date of Patent: Apr. 9, 2013

(54) BACK-TO-BACK BUNDLE STRAPPING MACHINE

(75) Inventors: Torsten Oehm, Wuppertal (DE); Kevin A. Bruzzesi, Cary, IL (US)

(73) Assignee: Illinois Tool Works Inc., Glenview, IL (US)

( * ) Notice: Subject to any disclaimer, the term of this patent is extended or adjusted under 35 U.S.C. 154(b) by 356 days.

(21) Appl. No.: 12/889,094

(22) Filed: Sep. 23, 2010

(65) Prior Publication Data

US 2011/0120321 A1 May 26, 2011

Related U.S. Application Data

(60) Provisional application No. 61/263,697, filed on Nov. 23, 2009.

(51) Int. Cl.
*B65B 13/02* (2006.01)

(52) U.S. Cl.
USPC ..... 100/2; 100/3; 100/4; 100/7; 100/26; 100/29; 53/589

(58) Field of Classification Search ..... 100/2, 3, 100/4, 7, 18, 26, 29; 53/399, 589
See application file for complete search history.

(56) References Cited

U.S. PATENT DOCUMENTS

| | | | | |
|---|---|---|---|---|
| 3,901,138 | A * | 8/1975 | Bilt | 100/4 |
| 4,605,456 | A | 8/1986 | Annis, Jr. | |
| 5,299,407 | A | 4/1994 | Schuttler | |
| 6,393,807 | B2 | 5/2002 | Tipton et al. | |
| 6,711,883 | B2 * | 3/2004 | Schwede et al. | 53/589 |
| 6,955,119 | B2 | 10/2005 | Bobrin | |

FOREIGN PATENT DOCUMENTS

| | | |
|---|---|---|
| EP | 0596288 B1 | 5/1994 |
| EP | 0739820 B1 | 10/1996 |
| GB | 1120778 | 7/1968 |

OTHER PUBLICATIONS

European Search Report issued in connection to 10014116.7-2308, dated Mar. 31, 2011.

* cited by examiner

*Primary Examiner* — Jimmy T Nguyen
(74) *Attorney, Agent, or Firm* — Levenfeld Pearlstein, LLC

(57) ABSTRACT

A strapping machine that includes a strap chute defining an arch through which loads are conveyed, the arch having an entrance and an exit, infeed and outfeed conveyors positioned at the arch entrance and exit, respectively, the conveyors defining a work surface, and a strapping head disposed at about the arch for conveying the strap around the loads, tensioning the strap, and securing the strap. The machine further includes a sensor disposed above the work surface and a controller. During operation in a back-to-back mode, the infeed and outfeed conveyors are actuated to move a first, strapped load, and a second, to be strapped load, through the arch, wherein the outfeed conveyor is driven at a faster speed than the infeed conveyor to create a gap between the first and second loads. The sensor senses the gap between the first and second loads and the infeed and outfeed conveyors are stopped when the second load is properly positioned within the arch, wherein the controller determines that the second load is properly positioned within the arch based on the sensing of the gap. The controller initiates a strapping operation for the second load during which the strap is pulled from the strap chute onto the second load, the strap is tensioned on the second load, and the strap is secured.

20 Claims, 2 Drawing Sheets

BACK-TO-BACK BUNDLE STRAPPING MACHINE

CROSS REFERENCE TO RELATED APPLICATIONS

This application claims the benefit of U.S. Provisional Application No. 61/263,697, filed Nov. 23, 2009.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention is directed to strapping machines and, more particularly to strapping machines for strapping loads fed in a back-to-back manner.

2. Background of the Invention

Strapping machines are in widespread use for applying a strap, such as a plastic strap, in a tensioned loop around a load. A typical strapping machine includes a strap chute for guiding the strap around the load, a strapping head through which the leading end of the strap is fed, and at which the strap is tensioned and secured to itself, and a strap dispenser to dispense a desired length of strap from a strap material supply.

In one application, the strapping machine is used to strap bundles of printed materials. For example, newspapers are often bundled and strapped for subsequent handling and transportation.

It is of course most efficient to bundle a series of loads in an automatic operation. Preferably, such an operation is fully automatic to alleviate the need for handling loads as they progress along a production line. In many such machines, conveyors and belts move the loads into and out of the strapping machine.

In an operation in which the loads approach the strapping machine in discrete, separated, and spaced-apart groups, such operation is readily accomplished. For example, a switch on the machine prior to the strap chute senses the presence or absence of a load. Once the switch is activated by the presence of the load on the switch and released by the passage of the load over the switch, a timing circuit actuates to measure a predetermined time at which the conveyor will stop to allow the strapping operation to proceed. The strapped load is then conveyed away from the chute and a similar cycle is commenced for the next load.

While this system functions well for loads or bundles of material that are separated and well spaced from one another, it has been found to have its drawbacks when bundles of material are disposed in a back-to-back progression, wherein the bundles are immediately next to one another or very closely spaced. For example, the bundles may be improperly strapped or not at all strapped when the bundles are so close that the switch remains depressed through multiple cycles or when the bundles are so close that the timing circuit does not correspond to bundle spacing. Generally, 3 to 4 bundles will be properly strapped (by virtue of the timing circuit being close in determining when to apply the next course of strap), but after about 3-4 bundles the timing is off. This results in misfed strap and requires the strapping machine to be shut down, the bundles realigned, and the system restarted. As such, it is often necessary to have an operator positioned at or near the machine at most times to assure that the bundles are properly positioned to enter the strapper and are properly strapped when leaving.

To avoid these problems, prior strapping machines have been fitted mechanical switches and optical sensors to determine when the loads entered the strapping machine arch area (at the strap chute) and when the loads exited the arch. Here, however, problems arose with loads contacting and actually striking bundle stop arms that were part of the machines. In addition, problems arose in situations where, for example, a single sheet of material, for example, a newspaper insert, was misaligned with the rest of the bundle, and the system could not detect when the bundle was in proper position for strapping or for conveyance out of the strapping machine arch.

Accordingly, there is a need for a strapping machine that can be used in back-to-back and normal spaced-apart bundle operations that will accurately control movement of the bundles and strapping thereof.

SUMMARY OF THE INVENTION

According to one example, a strapping machine configured to position a strap around loads, tension the strap around the loads, and secure the strap around the loads includes a strap chute through which the strap is conveyed and from which the strap is pulled and tensioned onto the loads. The chute defines an arch through which the loads are conveyed and the arch has an entrance and an exit. The strapping machine further includes infeed and outfeed conveyors positioned at the arch entrance and exit, respectively, and defining a work surface, a strapping head disposed at about the arch for conveying the strap around the loads, tensioning the strap, and securing the strap, a sensor disposed above the work surface, and a controller to control the strapping machine and effect a strapping operation. During operation in a back-to-back mode, the infeed and outfeed conveyors are actuated to move a first, strapped load, and a second, to be strapped load, through the arch. The outfeed conveyor is driven at a faster speed than the infeed conveyor to create a gap between the first and second loads. The sensor senses the gap between the first and second loads and the infeed and outfeed conveyors are stopped when the second load is properly positioned within the arch. The controller determines that the second load is properly positioned within the arch based on the sensing of the gap. The controller initiates a strapping operation for the second load during which the strap is pulled from the strap chute onto the second load, the strap is tensioned on the second load, and the strap is secured.

According to a second example, a strapping machine configured to position a strap around loads, tension the strap around the loads, and secure the strap around the loads includes a strap chute through which the strap is conveyed and from which the strap is pulled and tensioned onto the loads. The chute defines an arch through which the loads are conveyed and the arch has an entrance and an exit. The strapping machine also includes infeed and outfeed conveyors positioned at the arch entrance and exit, respectively, the conveyors defining a work surface, and a strapping head disposed at about the arch for conveying the strap around the loads, tensioning the strap, and securing the strap. Further, the strapping machine includes a switch located at about the work surface to determine the presence or absence of a load thereon, an optical sensor disposed above the work surface, and a controller having a timer and configured to control the strapping machine and effect a strapping operation.

In the second example, the controller is configured to operate in a back-to-back mode, wherein the infeed and outfeed conveyors are actuated to move a first, strapped load, and a second, to be strapped load, through the arch. The outfeed conveyor is driven at a faster speed than the infeed conveyor to create a gap between the first and second loads. The optical sensor senses the gap between the loads by measuring a gap distance and a gap height and the timer is actuated upon sensing the gap for a predetermined period of time at the end of which the second load is properly positioned within the arch and the infeed and outfeed conveyors are stopped. The controller is configured to initiate a strapping operation for the second load during which the strap is pulled from the strap chute onto the second load, the strap is tensioned on the second load, and the strap is secured.

Further, in the second example, the controller is configured to operate in a normal, non-back-to-back mode, wherein the infeed and outfeed conveyors are actuated to move the first load along the work surface, the first load activates the switch to indicate the presence of the first load on the infeed conveyor, and the timer is actuated upon activation of the switch for a predetermined period of time at the end of which the first load is properly positioned within the arch and the infeed and outfeed conveyors are stopped. The controller initiates the strapping operation for the first load and the infeed and outfeed conveyors are actuated to move the strapped first load through the arch, wherein the first load deactivates the switch to indicate the absence of the first load on the infeed conveyor and a second load subsequently activates the switch.

In a third example, a method of operating a strapping machine is disclosed, wherein the strapping machine includes a strap chute having an entrance and an exit through which the strap is conveyed and from which the strap is pulled and tensioned onto the loads, infeed and outfeed conveyors positioned at the chute entrance and exit, respectively, and defining a work surface, a strapping head disposed proximate the chute, a sensor disposed above the work surface, and a controller to control the strapping machine to operate in at least one of a back-to-back mode and a normal, non-back-to-back mode. Operation in the back-to-back mode includes the step of actuating the infeed and outfeed conveyors to move a first, strapped load, and a second, to be strapped load, along the chute, wherein the conveyors are driven to create a gap between the first and second loads. The method also includes the steps of sensing the gap between the first and second loads with the sensor and stopping the infeed and outfeed conveyors when the second load is properly positioned within the arch, wherein the controller determines that the second load is properly positioned within the chute based on the sensing of the gap. Further, the method includes the step of initiating a strapping operation for the second load during which the strap is pulled from the strap chute onto the second load, the strap is tensioned on the second load, and the strap is secured.

These and other features and advantages of the present invention will be apparent from the following detailed description, in conjunction with the appended claims.

BRIEF DESCRIPTION OF THE DRAWINGS

Details of the present invention, including non-limiting benefits and advantages, will become more readily apparent to those of ordinary skill in the relevant art after reviewing the following detailed description and accompanying drawings, wherein.

DETAILED DESCRIPTION

Figure 1:
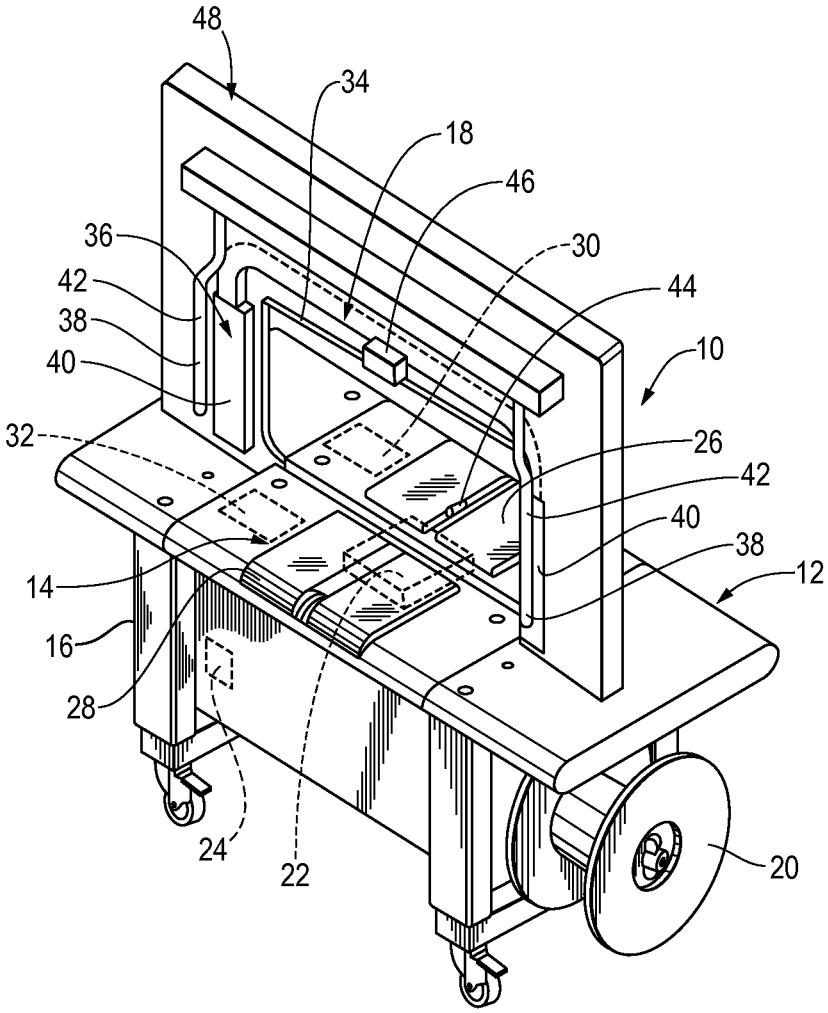
FIG. 1 is a perspective view of a strapping machine for back-to-back bundling according to one example.

While the present invention is susceptible of embodiment in various forms, there is shown in the drawings and will hereinafter be described an embodiment with the understanding that the present disclosure is to be considered an example of the invention and is not intended to limit the invention to the specific embodiment illustrated.

Referring to the FIGS., there is shown a strapping machine 10 of the type, for example, to strap a load L (shown generally in FIG. 2), such as newspapers or other bundled materials. The strapping machine 10 has a workstation, such as the illustrated tabletop 12, that forms part of an infeed-outfeed conveyor system 14, as will be described in more detail below.

The strapping machine 10 includes generally a frame 16, a chute 18 through which the strap S (shown generally in FIG. 2) is advanced during the strapping operation, and one or more strap dispensers 20 from which the strap is dispensed to a strapping head 22. The strapping head 22 is that component of the machine 10 that withdraws or pulls the strap from the dispenser 20, feeds the strap through the chute 18 grasps the leading end of the strap so as to bring it into contact with a trailing portion of strap, and tensions the trailing portion to strap the load. A controller 24 controls the operation of the machine 10. The controller 24 can be, for example, a PLC (programmable logic controller) or other type of automated control device or system.

The strap is then sealed onto itself or otherwise secured and severed from the supply 20 to allow for the strapped load to be conveyed from the machine 10. The overall arrangement and operation of such a strapping machine 10 is disclosed in Annis U.S. Pat. No. 4,605,456 and Schuttler U.S. Pat. No. 5,299,407, which patents are incorporated herein by reference in their entireties.

The conveyor system 14 includes an infeed conveyor 26, such as a belt or plurality of belts and an outfeed conveyor 28 that can also be, for example, a belt or plurality of belts. The conveyors are typically driven by motors or drives 30, 32, such as through use of drive rollers or the like. One example of one such drive system is disclosed in Bobren et al. U.S. Pat. No. 6,955,119, which is hereby incorporated by reference in its entirety.

The infeed conveyor 26 ends at about the strap chute 18 and the outfeed conveyor 28 begins at about the opposite side of the strap chute 18. In this arrangement, the conveyors 26, 28 are essentially separated by the chute 18. The strapping machine 10 can include a compression element 34 that compresses the load to facilitate the strapping operation and to preclude over-stressing the strap as it is tensioned around the load. As such when the load is compressed, compression is carried out by the element 34 rather than by the tensioning of the strap.

The conveyors 26, 28 are driven by drives 30, 32 such as a servo or like motors. This type of drive 30, 32 allows for precise control of the speed and positioning of the conveyors 26, 28 to properly place the load with respect to the strap chute 18 for strapping and to discharge or convey the load L from the strap chute. The infeed and outfeed conveyor drives 30, 32 are independent of one another so that the conveyors 26, 28 can be driven independently and at different speeds from each other. The strapping machine 10 may further include a side squaring or conditioning system 36 and bundle stops 38. The conditioning system 36 includes plates or other contact members 40 that move toward and away from the load (transverse to the conveyor 36, 38 direction) to square-up or condition the sides of the load. The contact members 40 can be driven by cylinders, motors, linkages, or like arrangements that will be appreciated by those skilled in the art.

The machine 10 may also includes one or more bundle stops 38 that move into the path of the bundle or load to stop forward motion of the bundle and to prevent material from the top of the bundle from sliding forward as the bundle is stopped. In one example, the bundle stops 38 move inwardly in a transverse direction to the conveyor direction and can be formed having an offset leg 42 that is pivoted or rotated as the stops 38 move inwardly. This arrangement facilitates contact and movement away from the bundle without affecting the bundle stack. The drive for the bundle stops 38, including the rotational or pivoting movement can be by cylinders, motors, linkages, or like arrangements that will be appreciated by those skilled in the art.

The machine 10 includes a mechanical or like switch 44 located at the infeed conveyor 26. The switch 44 detects the presence or absence of a load passing along the infeed conveyor 26 and entering the strap chute 18. In the present example, the switch 44 is located a short distance away from the strap chute 18 due to the configuration of the infeed conveyor 26 and to allow access to an underside of the work surface 12. Although in other examples, the position of the switch 44 may be modified as would be apparent to one of ordinary skill. The machine 10 also includes a sensor 46, such as a photoelectric proximity sensor. In one example, the sensor 46 is a laser-based optical sensor that emits light in any suitable frequency range, such as visible, infrared, ultraviolet, etc. In the present machine 10, the sensor 46 is located above an arch 48 at the outlet side of and above the chute 18. The sensor 46 is configured to detect a gap G between loads (shown generally in FIG. 2). In one example, the sensor 46 can detect a gap as small as about 1 mm (or about 0.04 inches). The sensor 46 is also configured to detect the height of the gap. That is, the sensor 46 can detect whether the gap is present at the bottom of the load or near the top of the load. In this manner, if there is an underwrapper that extends beyond a front edge (or an expected footprint) of the load, the sensor 46 can detect that it is only an underwrapper and the strapping operation can continue. On the other hand, if the sensor 46 detects that a portion of the load extends beyond the front edge of where the load footprint is expect to be, then the operation can be stopped. In another example, it is also contemplated that the sensor 46 can be located above the infeed conveyor 26.

The controller 24 is configured to automatically monitor and control the feed, discharge (e.g., the infeed and outfeed conveyors 26, 28), and strapping operation. However, it will be appreciated that upstream operations, for example, stacking of newspapers, likely are not controlled by the controller 24. As such, in the present machine 10, the controller 24 may be configured so that infeed, strapping, and outfeed operations are coordinated to allow for fast, automated, and proper feed, and strapping and discharge of loads in a spaced feed (normal) operation as well as a back-to-back feed operation.

In the spaced feed mode, there is sufficient space between each load or bundle for the mechanical switch 44 to be used to control strapping of each load. Referring generally to blocks 60, 62 of FIG. 2, as each load passes over the switch 44, a strapper timer circuit actuates or begins to time the movement of the load as it passes through the machine 10. Referring now to blocks 64, 66, when the timer circuit reaches a specified time that corresponds to a known length of the load and a known speed of the infeed conveyor 26, such as the time it takes for half of the load to pass through the chute 18, the controller 24 initiates a strapping operation. In one example of the strapping operation, the bundle stops 38 move/pivot inwardly to stop the load, the side conditioning elements 36 move inward to square up the sides, and the top compression element 34 moves downward from the strap chute area 18 to compress the load. Compression facilitates the strapping operation and specifically, the strap tensioning portion of the cycle by relying on the compression element 34 rather than the strap tensioning to compress or reduce the height of the load. The specified time at which the strapping operation is initiated can be predefined and modified depending on the size of the load and the speed of the infeed and/or outfeed conveyors 26, 28, as would be apparent to one of ordinary skill.

Further, during the strapping operation, the strap is fed through the strapping head 22, into and around the strap chute 18. When a leading end of the strap returns to and is sensed by the strapping head 22, feeding of the strap stops and the leading end is gripped in the strapping head. The strap is then released by and pulled from the chute 18 onto the load and the strap is tensioned. Overlying courses of strap material are sealed or joined to one another, the trailing end of the strap is severed from the feed, and the seal or joint is released from the strapping head 22.

Figure 2:
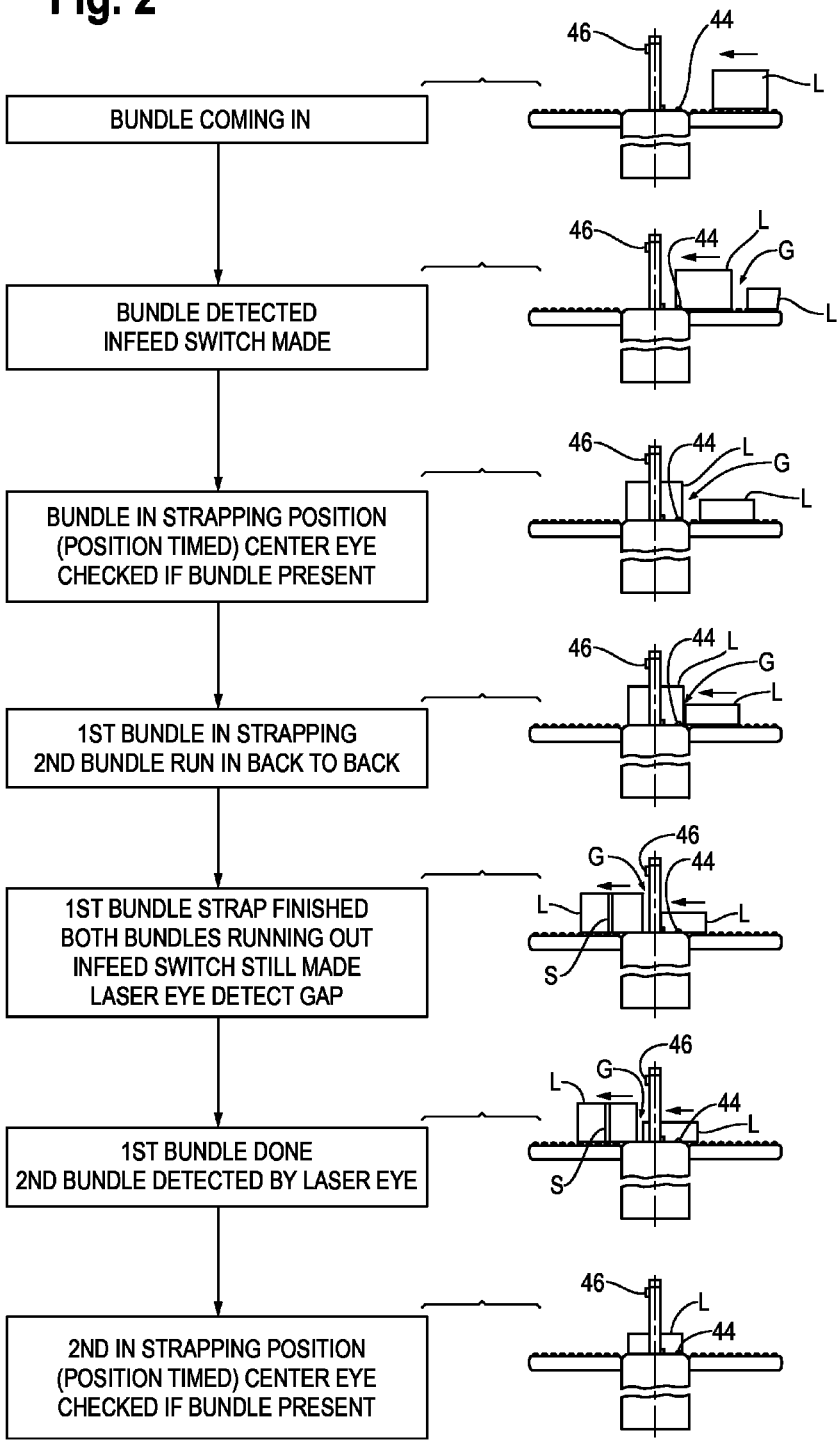
FIG. 2 is a flow diagram of a back-to-back bundling operation according to an example.

Referring generally to block 68 of FIG. 2, at the completion of the strapping operation, the top compression element 34 is released, the bundle stops 38 open, and the outfeed conveyor 28 actuates to move the load out of the strapping machine 10 to a downstream process, such as labeling, loading, transport, etc. At about the same time, the infeed conveyor 26 feeds a subsequent load or bundle into the machine 10 for strapping.

As set forth above, automatic strapping machines function well when there is sufficient space between the bundles or loads. When, however, the loads are in back-to-back progression, the narrow space between loads prevents use of the bundle stop elements 38. In addition, in back-to-back mode the switch 44 may not be properly depressed and released to indicate discreet loads due to the close spacing thereof. Consequently, use of the switch 44 alone to control initiation of the strapping procedure for each load may be inadequate.

The present machine 10 uses the controller 24, the switch 44, the sensor 46, and the infeed and outfeed conveyors 26, 28 to properly strap and move loads that are arranged in a back-to-back progression. In the back-to-back mode of operation, the switch 44 remains in the down or depressed state and the bundle stops 38 remain open. The conditioning and compression functions (i.e., the conditioning elements 36 and the compression element 34), however, remain operable, as described hereinabove.

With reference to blocks 66-72 of FIG. 2, as the loads are moved through the chute 18 and the arch 48, the sensor 46 detects a gap between the loads and senses the height of the gap. When the sensor 46 detects a gap between adjacent loads, a timer initiates to measure an appropriate delay to cease movement of the loads through the strap chute 18. For example, the appropriate delay may correspond to the time it takes for half of the load to pass through the chute 18 so that the load is centered in the chute. Alternatively or in combination, a counter, such as an encoder, or a distance sensor can be used determine the position of the loads with respect to the chute 18 and to control the conveyors 26, 28 to position the loads within the chute 18 in preparation for the strapping operation. Once the loads are properly positioned with respect to the chute 18, the conveyors 26, 28 are stopped for a period of time sufficient to perform the strapping operation. When the strapping operation is complete, the infeed and outfeed conveyors 26, 28 resume operation and the next load is positioned within the chute 18.

In the back-to-back mode, the outfeed conveyor 28 moves faster than the infeed conveyor 26. As shown by blocks 66-70 of FIG. 2, this pulls the just strapped load from the strap chute 18 and creates a gap between the next subsequent load and allows the next load to move into the strap chute 18 area without interference from the immediately prior strapped load. The strapped load can then be conveyed to a downstream operation and the next cycle of sensing a gap, timing or otherwise tracking the movement of the next load, stopping the conveyors 26, 28, and performing the strapping operation commences.

It will be appreciated that the present machine 10, which uses the sensor 46, can provide an additional level of control not available on known strapping machines operating in back-to-back mode. With the present machine 10, a gap between the bundles is sensed, as is the height of the gap. In this manner, the controller 24 can properly identify the space between adjacent loads and effect strapping of the loads. It will be appreciated by those skilled in the art that the nature of bundling materials such as newspapers and the like is that an under wrapper may extend between bundles or sections of the papers may be slightly out of longitudinal alignment.

Accordingly, the sensor 46, operated by the controller 24, is configured to determine when a gap in fact exists between adjacent loads (even with an under wrapper) and to properly position the loads under the strap chute 18 for strapping. Because the sensor 46 is configured to determine both the gap distance as well as the gap height, a determination can be made as to whether the anomaly, i.e., the change in the height of the surface of the load is a true gap between adjacent loads or, for example, an out of place top sheet. In addition, the determination can account for under wrappers and like bottom sheets that may extend beyond the bounds of the load. It will also be appreciated and understood by those skilled in the art that certain control system accommodations will be made for machines in which the sensor 46 is located above or at the infeed conveyor 26 rather than at the outlet side of the strap chute 18.

In the present disclosure, the words "a" or "an" are to be taken to include both the singular and the plural. Conversely, any reference to plural items shall, where appropriate, include the singular.

INDUSTRIAL APPLICABILITY

The strapping machine disclosed herein can be utilized to strap loads that are fed in a normal feed mode and in a back-to-back feed mode. More particularly, the strapping machines disclosed herein are capable of identifying the location at which to stop and strap a load without overshooting or undershooting the arch (strap chute), conveying loads beyond the strapping machine, and properly positioning a subsequent load for strapping.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A strapping machine configured to position a strap around loads, tension the strap around the loads, and secure the strap around the loads, the strapping machine comprising:

a strap chute through which the strap is conveyed and from which the strap is pulled and tensioned onto the loads, the chute defining an arch through which the loads are conveyed, the arch having an entrance and an exit;

infeed and outfeed conveyors positioned at the arch entrance and exit, respectively, the conveyors defining a work surface;

a strapping head disposed at about the arch for conveying the strap around the loads, tensioning the strap, and securing the strap;

a sensor disposed above the arch at an outlet side of and above the chute; and a controller to control the strapping machine and effect a strapping operation, wherein during operation in a back-to-back mode, the infeed and outfeed conveyors are actuated to move a first, strapped load, and a second, to be strapped load through the arch, wherein the outfeed conveyor is driven at a faster speed than the infeed conveyor to create a gap between the first and second loads, the sensor senses the gap between the first and second loads, and the sensor detects a height of the gap the infeed and outfeed conveyors are stopped when the second load is properly positioned within the arch, wherein the controller determines that the second load is properly positioned within the arch based on the sensing of the gap, and the controller initiates a strapping operation for the second load during which the strap is pulled from the strap chute onto the second load, the strap is tensioned on the second load, and the strap is secured.

2. The strapping machine of claim 1, wherein the sensor is an optical sensor configured to sense the gap distance and gap height and the controller processes the gap distance and gap height to identify a gap between the first and second loads.

3. The strapping machine of claim 1, wherein the controller further includes a timer, and when the sensor senses the gap between the first and second loads, the timer activates for a predetermined period of time at the end of which the second load is properly positioned within the arch and the infeed and outfeed conveyors are stopped.

4. The strapping machine of claim 1, wherein the strapping head is disposed below the work surface and the sensor is positioned at the arch exit and above the work surface.

5. The strapping machine of claim 1, wherein the infeed and outfeed conveyors include belts.

6. The strapping machine of claim 1, further comprising a compression element to compress the load prior to positioning and tensioning the strap around the load.

7. The strapping machine of claim 1, further comprising a conditioning element for squaring sides of the load prior to positioning and tensioning the strap around the load.

8. The strapping machine of claim 1, further comprising a stop element to stop movement of the load when it is properly positioned within the arch.

9. The strapping machine of claim 1, further comprising a switch located at about the work surface to determine the presence of a load thereon, wherein during operation in a normal, non-back-to-back mode, the infeed and outfeed conveyors are actuated to move the first load along the work surface, the first load activates the switch to indicate the presence of the first load on the infeed conveyor, the infeed and outfeed conveyors are stopped when the first load is properly positioned within the arch, the controller initiates the strapping operation, and the infeed and outfeed conveyors are actuated to move the strapped first load through the arch, wherein the first load deactivates the switch to indicate the absence of the first load on the infeed conveyor and a second load subsequently activates the switch.

10. The strapping machine of claim 9, further comprising a compression element to compress the load prior to positioning and tensioning the strap around the load.

11. The strapping machine of claim 9, further comprising a conditioning element for squaring sides of the load prior to positioning and tensioning the strap around the load.

12. The strapping machine of claim 9, further comprising a stop element to stop movement of the load when it is properly positioned within the arch.

13. A strapping machine configured to position a strap around loads, tension the strap around the loads, and secure the strap around the loads, the strapping machine comprising:

a strap chute through which the strap is conveyed and from which the strap is pulled and tensioned onto the loads, the chute defining an arch through which the loads are conveyed, the arch having an entrance and an exit;

infeed and outfeed conveyors positioned at the arch entrance and exit, respectively, the conveyors defining a work surface;

a strapping head disposed at about the arch for conveying the strap around the loads, tensioning the strap, and securing the strap;

a switch located at about the work surface to determine the presence or absence of a load thereon;

an optical sensor disposed above the arch at an outlet side of and above the chute; and a controller having a timer and configured to control the strapping machine and effect a strapping operation, wherein during operation in a back-to-back mode, the infeed and outfeed conveyors are actuated to move a first, strapped load, and a second, to be strapped load, through the arch, wherein the outfeed conveyor is driven at a faster speed than the infeed conveyor to create a gap between the first and second loads, the optical sensor senses the gap between the loads by measuring a gap distance and a gap height, the timer is actuated upon sensing the gap for a predetermined period of time at the end of which the second load is properly positioned within the arch and the infeed and outfeed conveyors are stopped, and the controller initiates a strapping operation for the second load during which the strap is pulled from the strap chute onto the second load, the strap is tensioned on the second load, and the strap is secured, and wherein during operation in a normal, non-back-to-back mode, the infeed and outfeed conveyors are actuated to move the first load along the work surface, the first load activates the switch to indicate the presence of the first load on the infeed conveyor, the timer is actuated upon activation of the switch for a predetermined period of time at the end of which the first load is properly positioned within the arch and the infeed and outfeed conveyors are stopped, the controller initiates the strapping operation for the first load, and the infeed and outfeed conveyors are actuated to move the strapped first load through the arch, wherein the first load deactivates the switch to indicate the absence of the first load on the infeed conveyor and a second load subsequently activates the switch.

14. The strapping machine of claim 13, further comprising a compression element to compress the load prior to positioning and tensioning the strap around the load in both the back-to-back and normal operating modes.

15. The strapping machine of claim 13, further comprising a conditioning element for squaring sides of the load prior to positioning and tensioning the strap around the load in both the back-to-back and normal operating modes.

16. The strapping machine of claim 13, further comprising a stop element to stop movement of the load when it is properly positioned within the arch during the normal operating mode.

17. A method of operating a strapping machine, wherein the strapping machine includes a strap chute having an entrance and an exit through which the strap is conveyed and from which the strap is pulled and tensioned onto the loads, infeed and outfeed conveyors positioned at the chute entrance and exit, respectively, and defining a work surface, a strapping head disposed proximate the chute, a sensor disposed above an arch at an outlet side of and above the chute, and a controller to control the strapping machine to operate in at least one of a back-to-back mode and a normal, non-back-to-back mode, wherein operation in the back-to-back mode comprises the steps of:

actuating the infeed and outfeed conveyors to move a first, strapped load, and a second, to be strapped load, along the chute, wherein the outfeed conveyor is driven at a faster speed than the infeed conveyor to create a gap between the first and second loads;

sensing the gap between the first and second loads with the sensor;

sensing a height of the gap with the sensor;

stopping the infeed and outfeed conveyors when the second load is properly positioned within the arch, wherein the controller determines that the second load is properly positioned within the chute based on the sensing of the gap; and initiating a strapping operation for the second load during which the strap is pulled from the strap chute onto the second load, the strap is tensioned on the second load, and the strap is secured.

18. The method of claim 17, further comprising the step of activating a timer when the sensor senses the gap, wherein the timer is activated for a predetermined period of time at the end of which the second load is properly positioned within the arch and the step of stopping the infeed and outfeed conveyors is performed.

19. The method of claim 17, wherein the strapping machine further includes a switch located at about the work surface to determine the presence of a load thereon, and wherein operation in the normal mode comprises the steps of:

actuating the infeed and outfeed conveyors to move the first load along the work surface so that the first load activates the switch to indicate the presence of the first load on the infeed conveyor;

stopping the infeed and outfeed conveyors when the first load is properly positioned within the chute;

initiating a strapping operation for the first load; and actuating the infeed and outfeed conveyors to move the strapped first load through the chute so that first load deactivates the switch and a second load subsequently activates the switch.

20. The method of claim 17, wherein the strapping machine further includes a compression element, a conditioning element, and stop element, wherein the method of operating the strapping machine further includes the steps of:

compressing the load with the compression element;

squaring sides of the load with the conditioning element; and optionally, stopping movement of the load with the stop element when the load is properly positioned within the arch.

* * * * *